US007617886B2

(12) United States Patent
Hall

(10) Patent No.: US 7,617,886 B2
(45) Date of Patent: Nov. 17, 2009

(54) FLUID-ACTUATED HAMMER BIT

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 190 days.

(21) Appl. No.: 12/019,782

(22) Filed: Jan. 25, 2008

(65) Prior Publication Data

US 2008/0135295 A1 Jun. 12, 2008

Related U.S. Application Data

(63) Continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,789, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,426,968, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/24* (2006.01)

(52) U.S. Cl. ..... 175/51; 175/56; 175/297; 175/324; 175/393

(58) Field of Classification Search ..... 175/51, 175/56, 57, 296, 297, 339, 324, 393
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kuhne |
| 946,060 | A | 1/1910 | Looker |
| 1,116,154 | A | 11/1914 | Stowers |
| 1,183,630 | A | 5/1916 | Bryson |

(Continued)

*Primary Examiner*—Hoang Dang
(74) *Attorney, Agent, or Firm*—Tyson J. Wilde

(57) ABSTRACT

In one aspect of the present invention, a drilling assembly has a string of downhole tools connected to a drill bit with a bit body intermediate a shank and a working face. The drill bit is connected to the string of tools at the shank. A continuous fluid passageway is formed within the bit body and the string of tools. A valve mechanism disposed within the fluid passageway is adapted to substantially cyclically build-up and release pressure within the fluid passageway such that a pressure build-up results in radial expansion of at least a portion of the fluid passageway and wherein a pressure release results in a contraction of the portion of the fluid passageway. The expansion and contraction of the portion of the fluid passageway varies a weight loaded to the drill bit.

20 Claims, 9 Drawing Sheets

U.S. PATENT DOCUMENTS 1,189,560 A 7/1916 Gondos
1,360,908 A 11/1920 Everson
1,387,733 A 6/1921 Midgett
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,830,122 A * 5/1989 Walter ..... 175/106
4,836,301 A * 6/1989 Van Dongen et al. ..... 175/61
4,852,672 A 8/1989 Behrens
4,889,017 A 12/1989 Fuller
4,962,822 A 10/1990 Pascale
4,981,184 A 1/1991 Knowlton
4,991,667 A * 2/1991 Wilkes et al. ..... 175/61
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hutt
5,553,678 A * 9/1996 Barr et al. ..... 175/73
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,758,731 A * 6/1998 Zollinger ..... 175/99
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,089,332 A * 7/2000 Barr et al. ..... 175/45
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 7/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,588,518 B2 * 7/2003 Eddison ..... 175/296
6,594,881 B2 7/2003 Tibbitts
6,601,454 B1 8/2003 Bolnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,929,076 B2 4/2005 Fanuel
6,953,096 B2 10/2005 Glenhill
2001/0054515 A1 * 12/2001 Eddison et al. ..... 175/56
2002/0050359 A1 * 5/2002 Eddison ..... 166/321
2003/0213621 A1 11/2003 Britten
2004/0238221 A1 12/2004 Runia
2004/0256155 A1 12/2004 Kriesels

* cited by examiner

FLUID-ACTUATED HAMMER BIT

CROSS REFERENCE TO RELATED APPLICATIONS

This Patent Application is a continuation-in-part of U.S. patent application Ser. No. 11/837,321 filed Aug. 10, 2007 now U.S. Pat. No. 7,559,379 which is a continuation-in-part of U.S. patent application Ser. No. 11/750,700 filed May 18, 2007 now U.S. Pat. No. 7,549,489. U.S. patent application Ser. No. 11/750,700 is a continuation-in-part of U.S. patent application Ser. No. 11/737,034 filed Apr. 18, 2007 now U.S. Pat. No. 7,503,405. U.S. patent application Ser. No. 11/737,034 is a continuation-in-part of U.S. patent application Ser. No. 11/686,638 now filed Mar. 15, 2007 now U.S. Pat. No. 7,424,922. U.S. patent application Ser. No. 11/686,638 is a continuation-in-part of U.S. patent application Ser. No. 11/680,997 filed Mar. 1, 2007 now U.S. Pat. No. 7,419,016. U.S. patent application Ser. No. 11/680,997 is a continuation-in-part of U.S. patent application Ser. No. 11/673,872 filed Feb. 12, 2007 now U.S. Pat. No. 7,484,576. U.S. patent application Ser. No. 11/673,872 is a continuation-in-part of U.S. patent application Ser. No. 11/611,310 filed Dec. 15, 2006 now U.S. Pat. No. 7,600,586. This patent application is also a continuation-in-part of U.S. patent application Ser. No. 11/278,935 filed Apr. 6, 2006 now U.S. Pat. No. 7,426,968. U.S. patent application Ser. No. 11/278,935 is a continuation-in-part of U.S. patent application Ser. No. 11/277,394 filed Mar. 24, 2006 now U.S. Pat. No. 7,426,968. U.S. patent application Ser. No. 11/277,394 is a continuation-in-part of U.S. patent application Ser. No. 11/277,380 filed Mar. 24, 2006 now U.S. Pat. No. 7,337,858. U.S. patent application Ser. No. 11/277,380 is a continuation-in-part of U.S. patent application Ser. No. 11/306,976 filed Jan. 18, 2006 now U.S. Pat. No. 7,360,610. U.S. patent application Ser. No. 11/306,976 is a continuation-in-part of 11/306,307 filed Dec. 22, 2005 now U.S. Pat. No. 7,225,886. U.S. patent application Ser. No. 11/306,307 is a continuation-in-part of U.S. patent application Ser. No. 11/306,022 filed Dec. 14, 2005 now U.S. Pat. No. 7,198,119. U.S. patent application Ser. No. 11/306,022 is a continuation-in-part of U.S. patent application Ser. No. 11/164,391 filed Nov. 21, 2005 now U.S. Pat. No. 7,270,196. All of these applications are herein incorporated by reference in their entirety.

BACKGROUND OF THE INVENTION

This invention relates to the field of percussive tools used in drilling. More specifically, the invention relates to the field of downhole jack hammers which may be actuated by the drilling fluid. Typically, traditional percussion bits are activated through a pneumonic actuator. Through this percussion, the drill string is able to more effectively apply drilling power to the formation, thus aiding penetration into the formation.

The prior art has addressed the operation of a downhole hammer actuated by drilling mud. Such operations have been addressed in the U.S. Pat. No. 4,819,745 to Walter, which is herein incorporated by reference for all that it contains. The '745 patent discloses a simple and economical device placed in a drill string to provide a pulsating flow of the pressurized drilling fluid to the jets of the drill bit to enhance chip removal and provide a vibrating action in the drill bit itself thereby to provide a more efficient and effective drilling operation.

U.S. Pat. No. 6,588,518 to Eddison, which is herein incorporated by reference for all that it contains, discloses a downhole drilling method comprising producing pressure pulses in drilling fluid using measurement-while-drilling (MWD) apparatus and allowing the pressure pulses to act upon a pressure responsive device to create an impulse force on a portion of the drill string.

U.S. Pat. No. 4,890,682 to Worrall, et al., which is herein incorporated by reference for all that it contains, discloses a jarring apparatus provided for vibrating a pipe string in a borehole. The apparatus thereto generates at a downhole location longitudinal vibrations in the pipe string in response to flow of fluid through the interior of said string.

BRIEF SUMMARY OF THE INVENTION

In one aspect of the present invention, a drilling assembly has a string of downhole tools connected to a drill bit with a bit body intermediate a shank and a working face. The drill bit is connected to the string of tools at the shank. A continuous fluid passageway is formed within the bit body and the string of tools. A valve mechanism disposed within the fluid passageway is adapted to substantially cyclically build-up and release pressure within the fluid passageway such that a pressure build-up results in radial expansion of at least a portion of the fluid passageway and wherein a pressure release results in a contraction of the portion of the fluid passageway. The expansion and contraction of the portion of the fluid passageway varies a weight loaded to the drill bit. The valve mechanism may comprise a rotary valve or a relief valve.

In another aspect of the present invention, a method has steps for forming a wellbore. The bit connected to the string of tools is deployed into a wellbore and fluid is continuously passed through the fluid passageway. At least a portion of the weight of the string of downhole tools is loaded to the drill bit. Pressure is substantially cyclically built up and released within the fluid passageway such that a pressure build-up results in radial expansion of at least a portion of the fluid passageway and wherein a pressure release results in a contraction of the portion of the fluid passageway. Resultantly, expanding and contracting the portion of the fluid passageway substantially cyclically varies the weight loaded to the drill bit.

The step of substantially cyclically varying the weight loaded to the drill bit may vibrate the drill bit. A magnitude of the vibrations may vary according to the physical properties of a formation being drilled. The vibrations of the tool string may produce acoustic signals; the signals being received by acoustic receivers located at the tool bit, tool string, or earth surface. The drill bit may be a shear bit or a rollercone bit and the drill bit may be rigidly connected to the string of tools at the shank. The step of expanding and contracting the inner wall of the tool string may be continuous. The step of building up and releasing pressure within the fluid passageway may be controlled by a valve mechanism disposed within the fluid passageway. The valve mechanism may have a rotary valve or a relief valve. In some embodiments, the valve mechanism may be adapted to restrict all fluid flow within the fluid passageway wherein in other embodiments the valve mechanism may be adapted to restrict a portion of the fluid flow. A portion of the valve mechanism may be adapted for attachment to a driving mechanism. The driving mechanism may be a motor, turbine, electric generator, or a combination thereof. The driving mechanism may also be controlled by a closed loop system.

In some embodiments, at least a portion of a jack element being disposed within the body may comprise an end forming at least a portion of the valve mechanism in the fluid passageway and a distal end substantially protruding from the working face. The jack element may be rotationally isolated from the string of downhole tools.

The substantially cyclical building-up and releasing of pressure may have a rate of 0.1 to 500 cycles per second. Also, the step of substantially cyclically varying the weight loaded to the drill bit may induce a resonant frequency of the formation being drilled so that the formation may be more easily broken up.

DETAILED DESCRIPTION OF THE INVENTION AND THE PREFERRED EMBODIMENT

Figure 1:
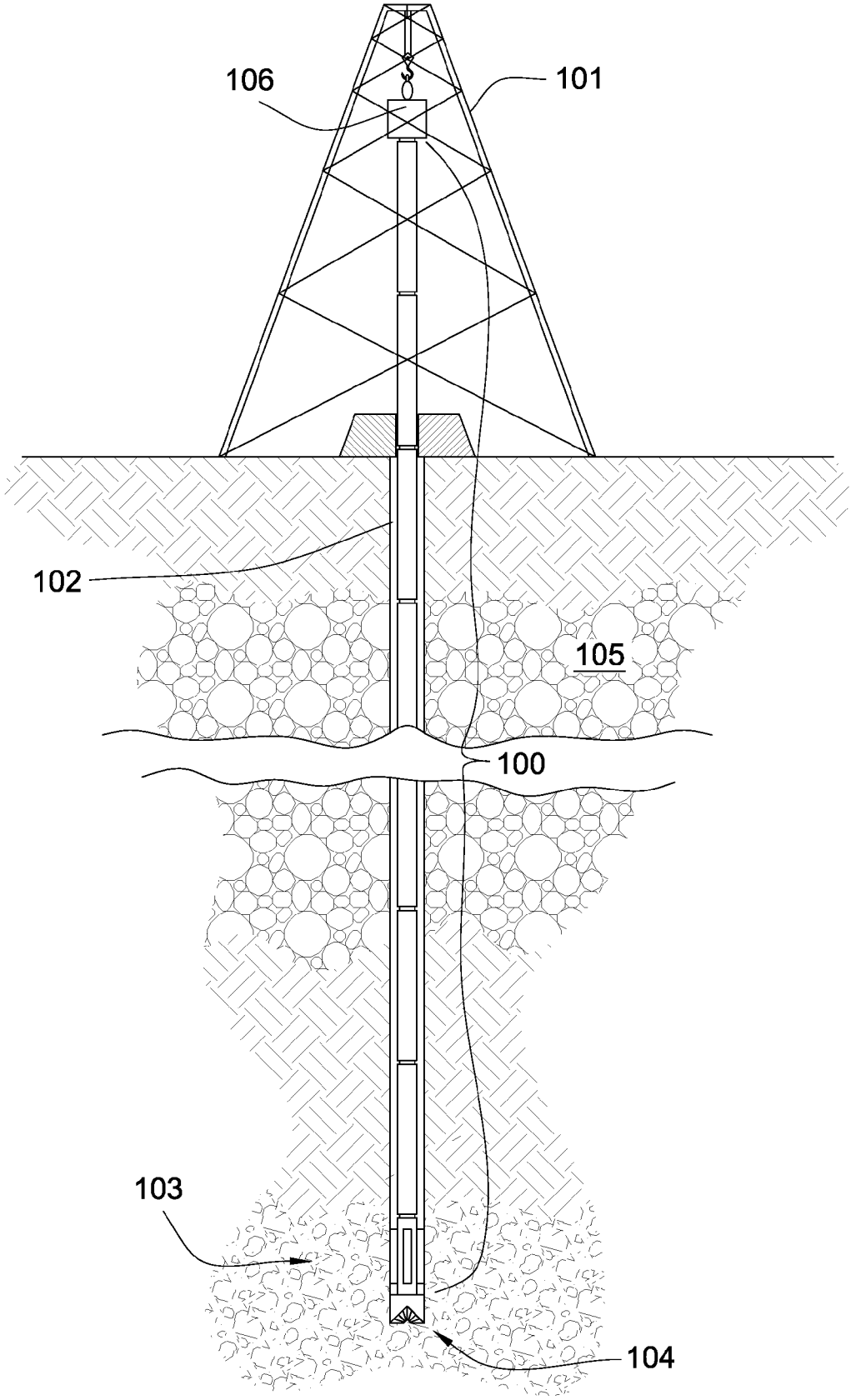
FIG. 1 is a perspective diagram of an embodiment of a string of downhole tools suspended in a borehole.

FIG. 1 is a perspective diagram of an embodiment of a string of downhole tools 100 suspended by a derrick 101 in a borehole 102. A bottom-hole assembly 103 is located at the bottom of the borehole 102 and comprises a drill bit 104. As the drill bit 104 rotates downhole the tool string 100 advances farther into the earth. The drill string 100 may penetrate soft or hard subterranean formations 105. The bottom-hole assembly 103 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 103. U.S. Pat. No. 6,670,880 which is herein incorporated by reference for all that it contains, discloses a telemetry system that may be compatible with the present invention; however, other forms of telemetry system that may be compatible with the present invention; however, other forms of telemetry may also be compatible such as systems that include mud pulse systems, electromagnetic waves, radio waves, wire pipe, and/or short hop. In some embodiments, no telemetry system is incorporated into the drill string.

Figure 2:
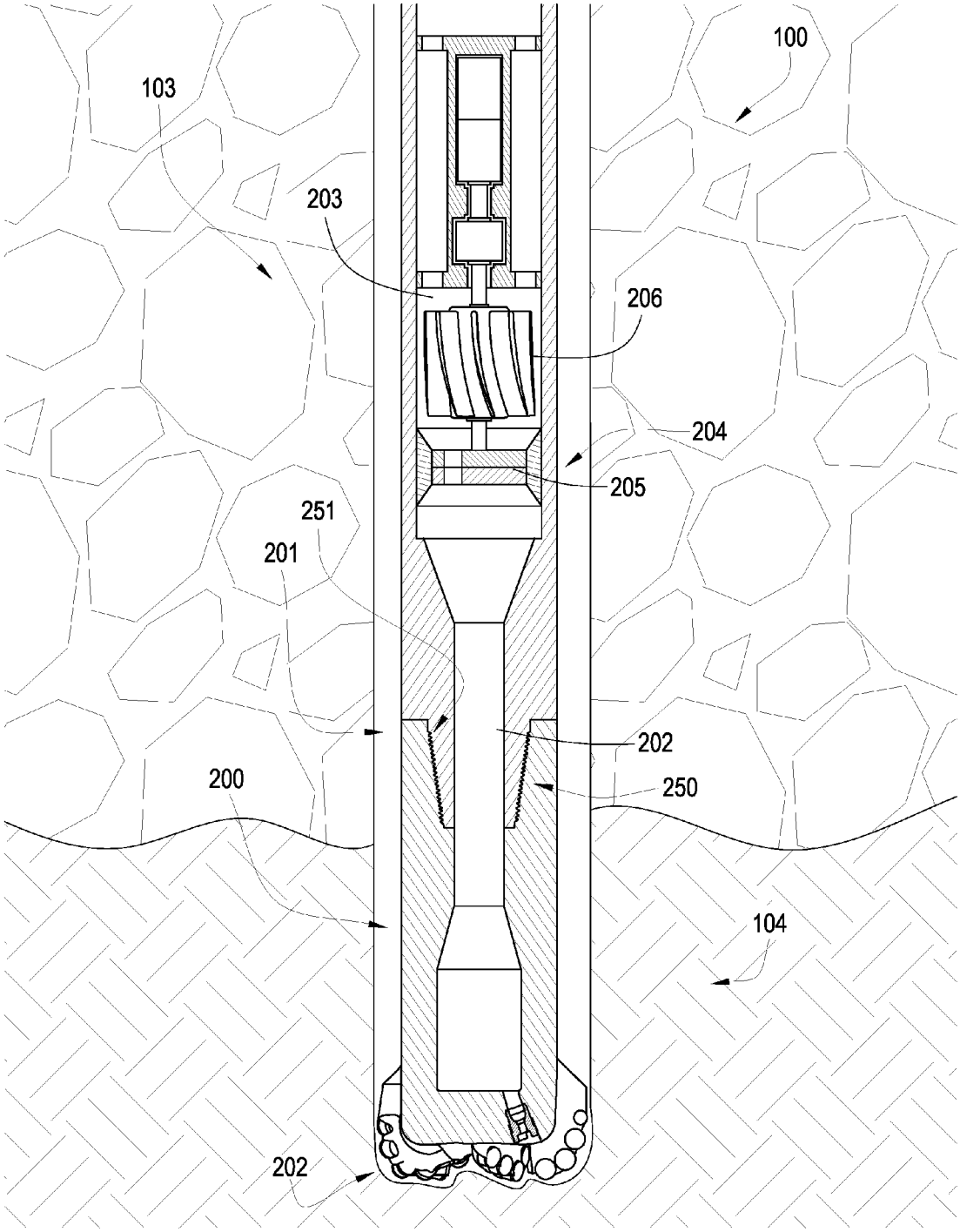
FIG. 2 is a cross-sectional diagram of an embodiment of a bottom-hole assembly.

FIG. 2 illustrates a cross-sectional diagram of an embodiment of a bottom-hole assembly 103. The drilling assembly comprises a string of downhole tools 100 connected to the drill bit 104 with a bit body 200 intermediate a shank 201 and a working face 202. The drill bit 104 is connected to the string of tools 100 at the shank 201. The drill bit 104 may have a rigid connection to the string of tools 100 at the shank 201. In the preferred embodiment, the drill bit 104 may comprise a thread 250; the thread 250 being adapted to mate with another thread 251 of the string of tools 100. The drilling assembly also includes a continuous fluid passageway 203 being formed within the bit body 200 and the string of tools 100. A valve mechanism 204 is disposed within the fluid passageway 203. In the preferred embodiment, the valve mechanism 204 comprises a rotary valve 205. In other embodiments, the valve mechanism may comprise a relief valve. A portion of the valve mechanism 204 may be adapted for attachment to a driving mechanism 206; the driving mechanism 206 being controlled by a closed loop system. The driving mechanism may be a motor, turbine, electric generator, or a combination thereof. In this embodiment, the drill bit 104 is a shear bit.

Figure 3A:
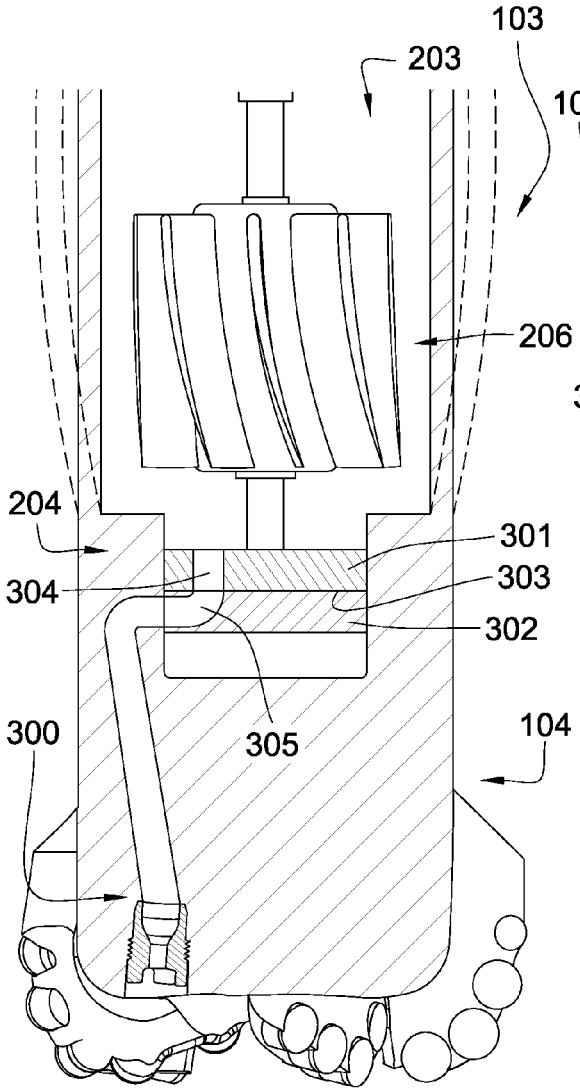
FIG. 3*a* is a cross-sectional diagram of another embodiment of a bottom-hole assembly.
Figure 3B:
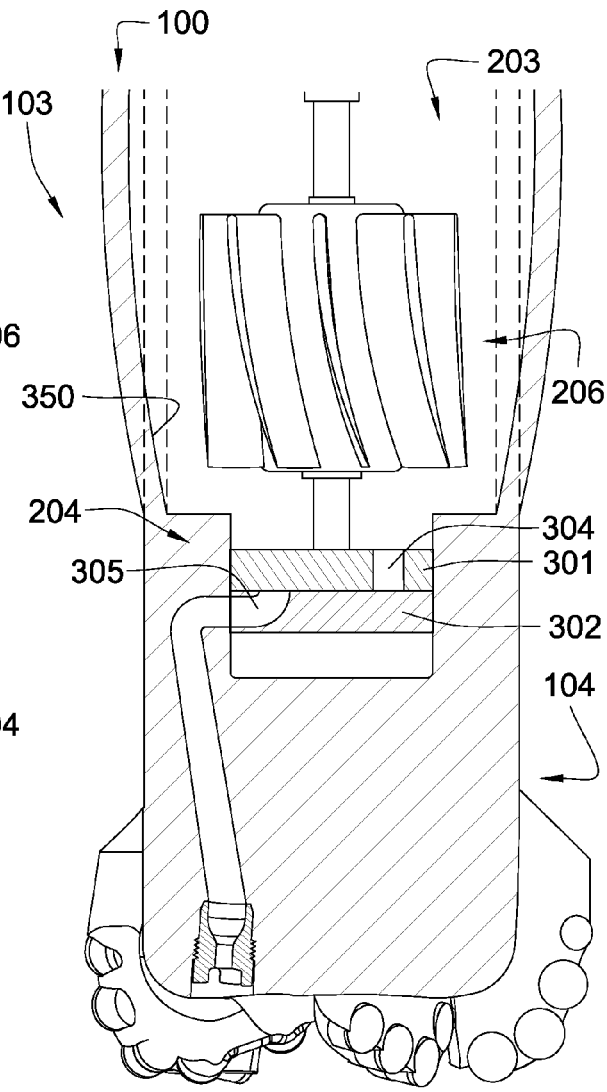
FIG. 3*b* is a cross-sectional diagram of another embodiment of a bottom-hole assembly.

FIGS. 3*a* and 3*b* illustrate a bottom-hole assembly 103 adapted to form a wellbore. During a drilling operation, fluid is continuously passed through the fluid passageway 203. A driving mechanism 206 may be disposed within the fluid passageway. In this embodiment, the driving mechanism is a turbine. FIG. 3*a* shows the valve mechanism 204, the valve mechanism 204 being a rotary valve. The rotary valve has a first disc 301 attached to the driving mechanism 206 and a second disc 302 axially aligned with and contacting the first disc 301 along a flat surface 303. As the discs rotate relative to one another at least one port 304 formed in the first disc 301 aligns with another port 305 formed in the second disc 302, thereby allowing fluid to flow through the valve to a nozzle 300 formed in the drill bit 104. Referring now to the embodiment illustrated in FIG. 3*b*, the fluid ports 304, 305, formed in the first disc 301 and the second disc 302, respectively, may be misaligned, thereby prohibiting fluid to flow through the valve mechanism 204. As the pressure builds up within the fluid passageway 206, pressure is applied to an inner wall 350 of the string of downhole tools 100. It is believed that the building up of pressure may cause the wall 350 of the pipe 100 to expand, causing a weight on the drill bit 104 to decrease and thereby shortening the length of the drill bit 104. As the ports 304, 305, of the valve mechanism 204 are misaligned, the valve mechanism 204 may be adapted to restrict a portion of the fluid flow or all the fluid flow through the fluid passageway 206. The continuous rotation of the discs 301, 302, relative to each other results in a substantially cyclical building-up and releasing of pressure within the fluid passageway 206. It is believed that varying the weight loaded to the drill bit 104 may vibrate the drill bit 104 and thereby more easily break up the formation being drilled. The substantially cyclical building-up and releasing of pressure may operate at a rate of 0.1 to 500 cycles per second.

Figure 4:
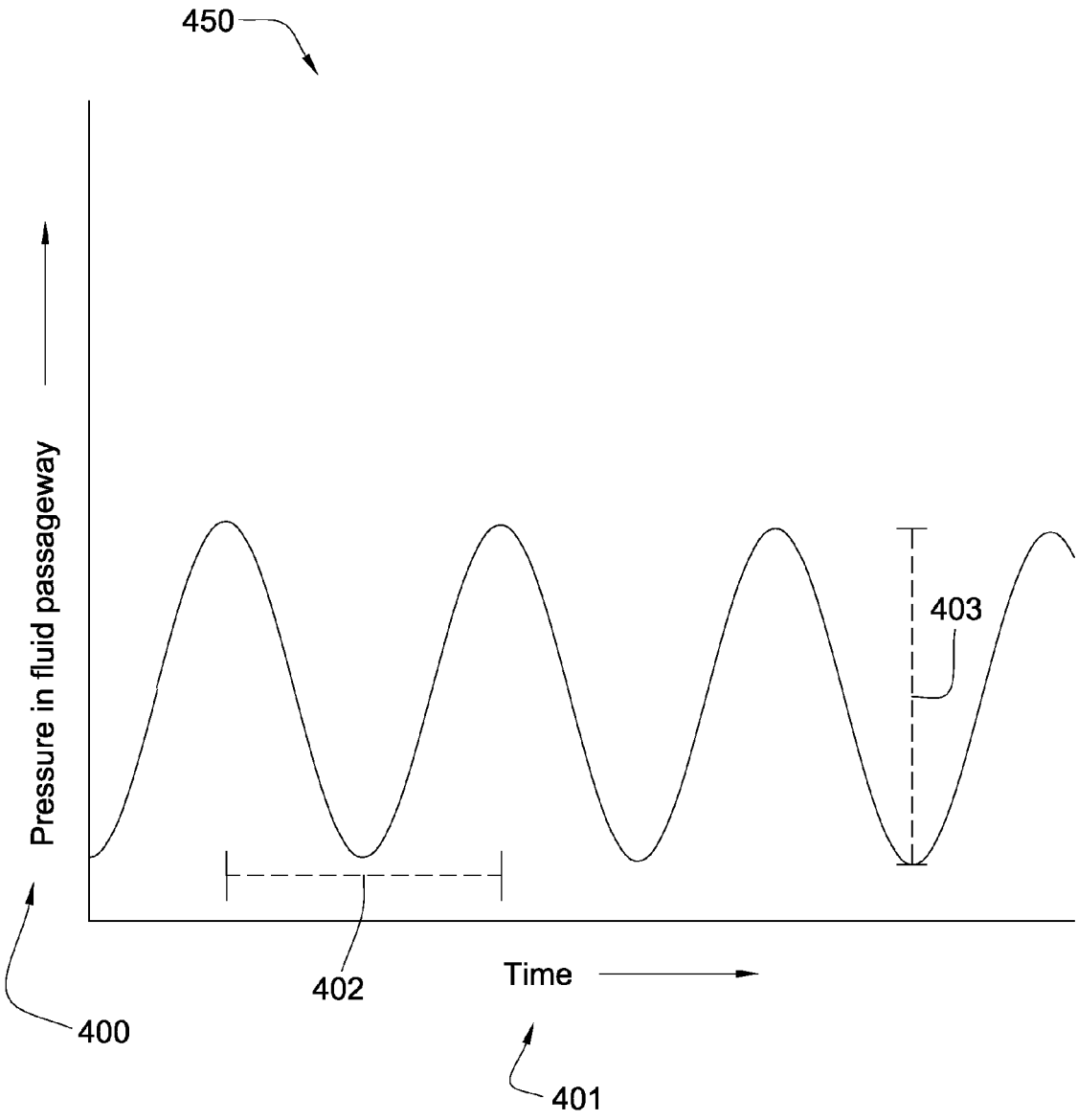
FIG. 4 is a graph representing fluid passageway pressures as a function of time during a drilling operation.

Referring now to FIG. 4, a graph 450 representing fluid passageway pressures 400 as a function of time 401 during a drilling operation illustrates the substantially cyclical behavior of the weight being loaded to the drill bit. The substantially cyclical varying the weight loaded to the drill bit may vibrate the drill bit. The building-up and releasing of pressure within the fluid passageway may have a rate of 0.1 to 500 cycles 402 per second. A magnitude 403 of the vibration cycles may vary as the drill bit encounters formations of varying densities and porosities.

Figure 5:
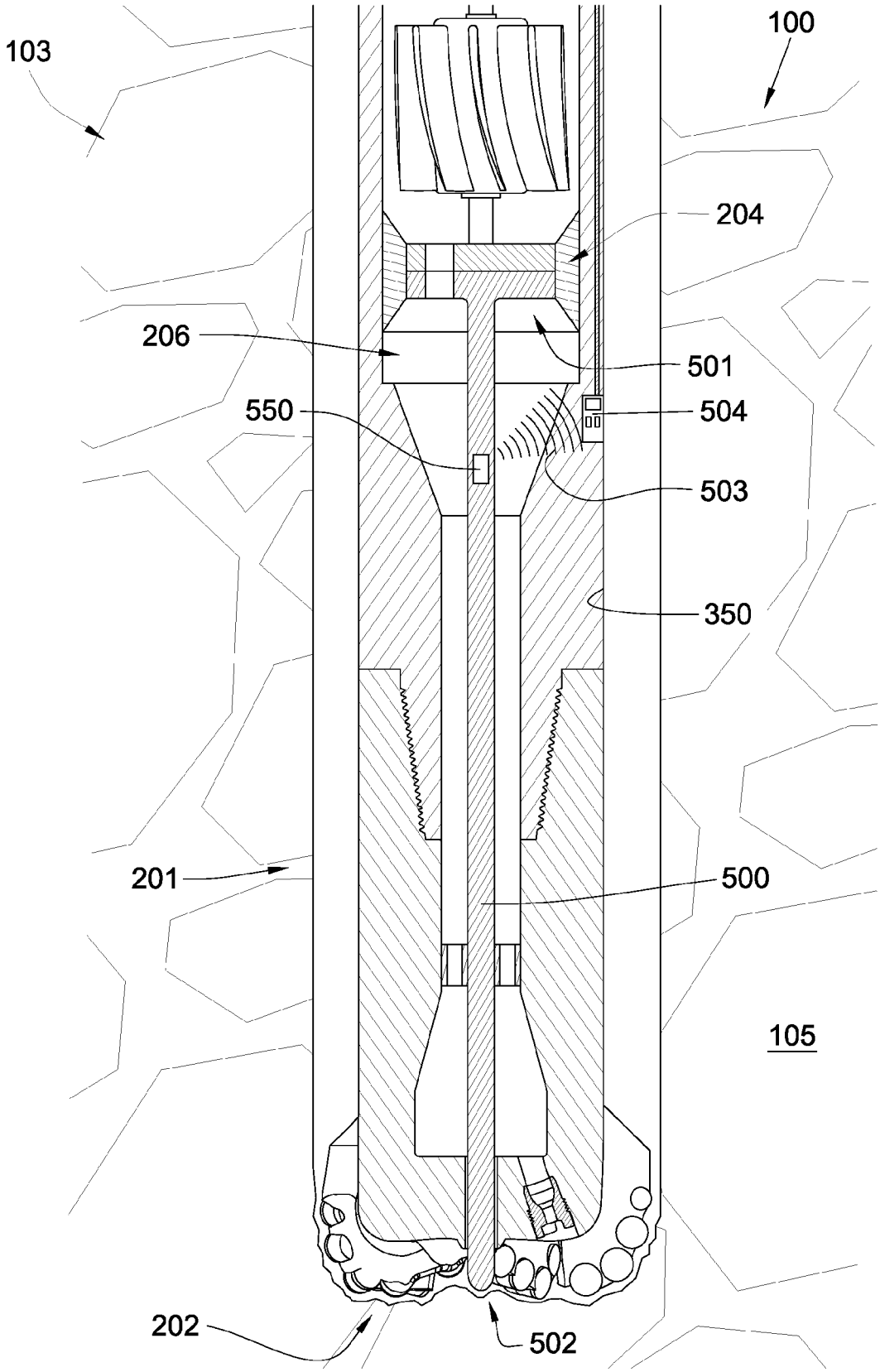
FIG. 5 is a cross-sectional diagram of another embodiment of a bottom-hole assembly.

FIG. 5 illustrates a diagram of another embodiment of a bottom-hole assembly 103. In this embodiment, at least a portion of a jack element 500 being disposed within the body 201 and comprising an end 501 forming at least a portion of the valve mechanism 204 within the fluid passageway 206 and a distal end 502 substantially protruding from the working face 202. The jack element 500 may be rotationally isolated from the string of downhole tools 100 such that a portion of the valve mechanism 204 may be controlled by the jack element 500 as the drill bit rotates relative to the valve mechanism 204. In this embodiment, a sensor 550 may be attached to the jack element 500. The sensor 550 may be a geophone, a hydrophone or another seismic sensor. The sensor 550 may receive acoustic reflections 503 produced by the vibrations of the jack element 500. Electrical circuitry 504 may be disposed within the wall 350 of the pipe 100. The electrical circuitry 504 may sense acoustic reflections 503 from the sensor 550. In other embodiments, the acoustic sensor may be located at the tool bit, tool string, or earth surface. The magnitude of the vibrations may vary according to the physical properties, such as density and porosity, of the formation 105 being drilled. For example, while drilling through a softer formation, it may not be necessary to have a larger rate of vibration than when drilling through a harder formation. The expanding and contracting the inner wall 350 of the tool string 100 may be continuous, yet may comprise varying rates.

Figure 6:
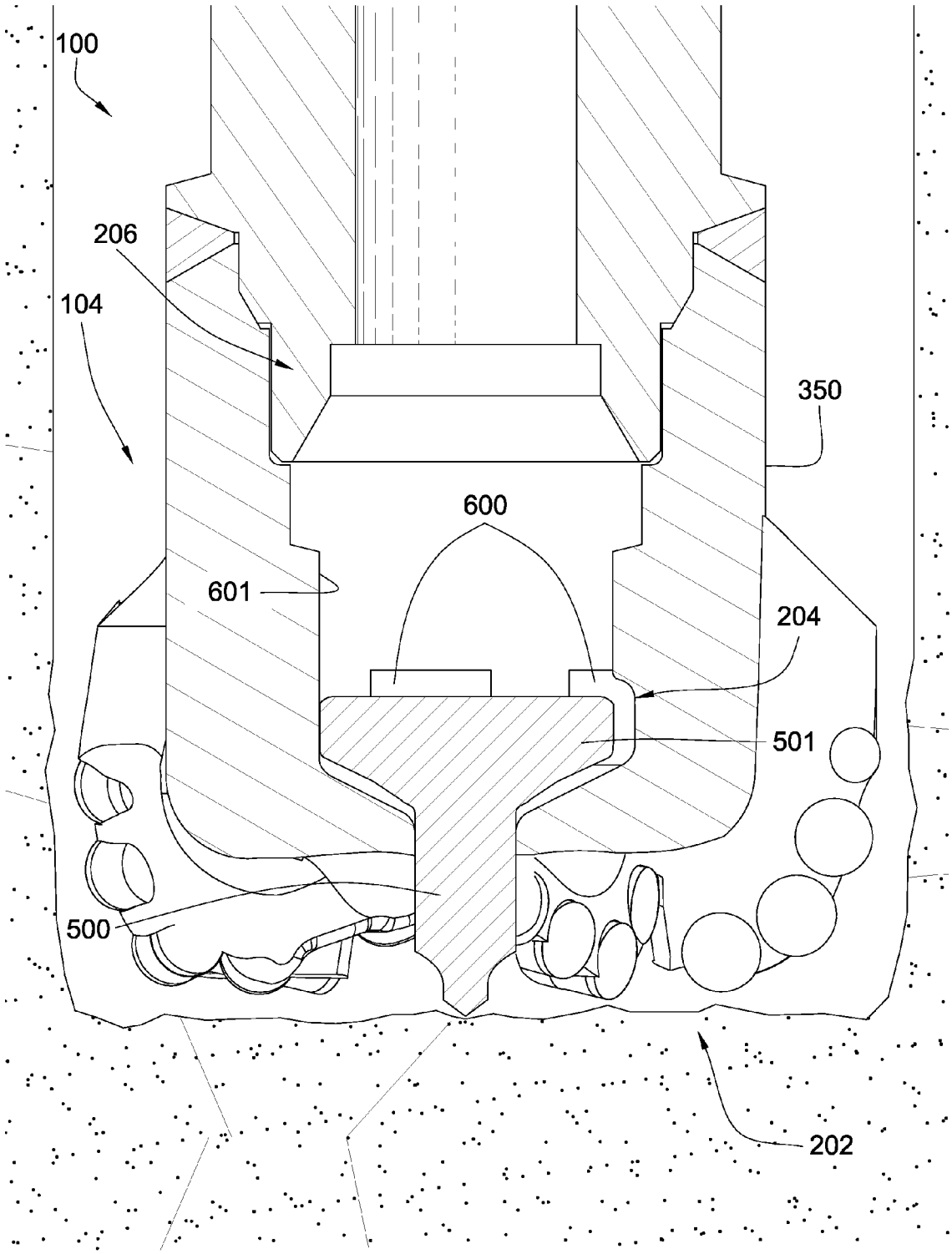
FIG. 6 is a cross-sectional diagram of another embodiment of a bottom-hole assembly.

FIG. 6 is another embodiment of a bottom-hole assembly comprising a jack element 500. An end 501 of the jack element 500 may form a portion of a valve mechanism 204. In this embodiment, the valve mechanism 204 comprises a relief valve. As fluid flows continuously through the fluid passageway 206, the jack element 500 may restrict fluid flow through the passageway 206 to at least one port 600 formed within a wall 601 of the fluid passageway 203. The restricted fluid flow may cause a pressure to build up in the fluid passageway 206 of the string of downhole tools 100, thereby causing the wall 350 of the pipe 100 to expand. The fluid pressure may force the jack element 500 into the formation 105 being drilled, allowing the fluid to pass through the at least one port 600, directing fluid to at least one nozzle disposed within an opening in the working face 202, thereby relieving the fluid pressure and allowing the wall 350 of the pipe 100 to contract. The continuous expanding and contracting of the wall of the pipe may cause the drill bit to vibrate and thereby more efficiently break up the formation being drilled.

Figure 7:
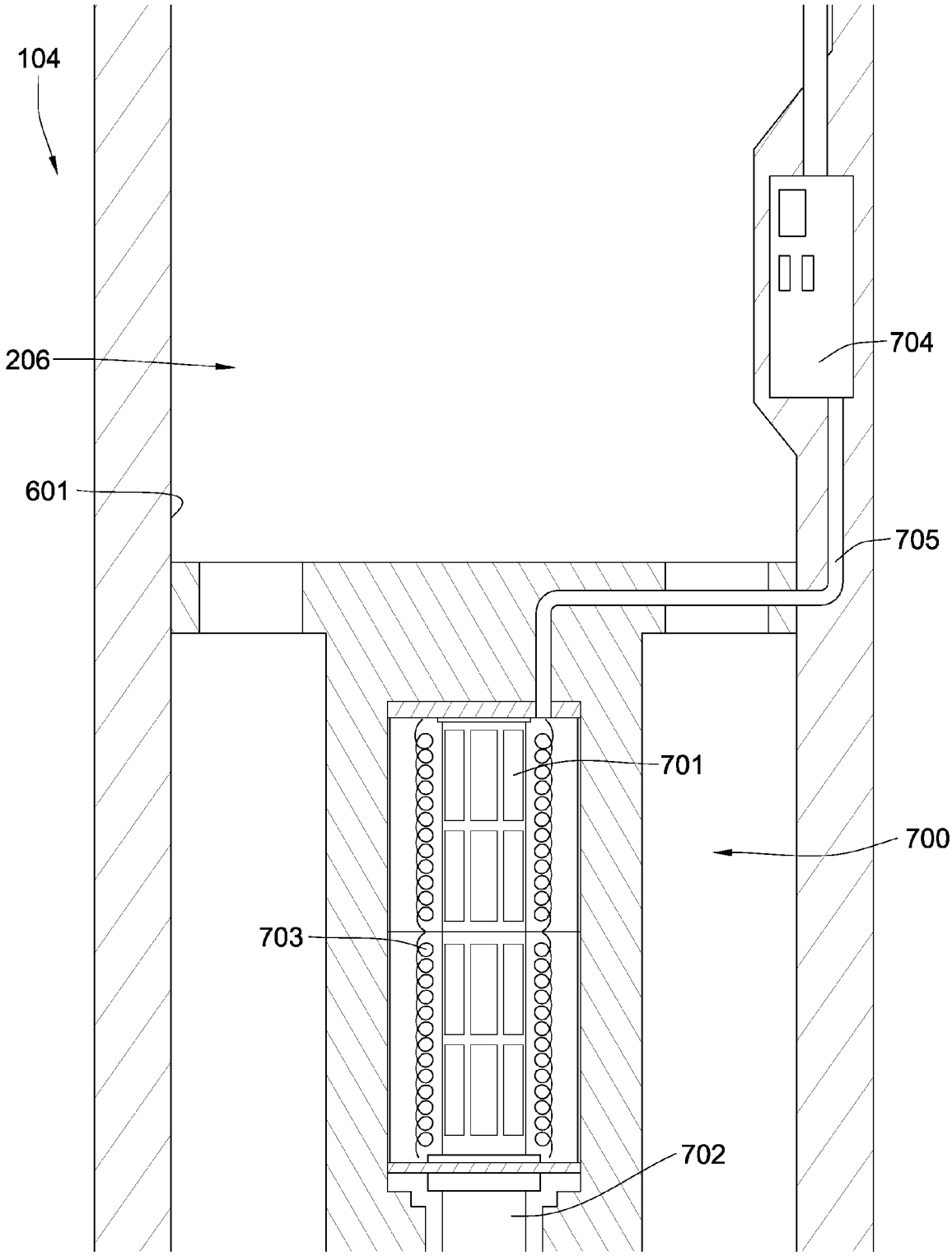
FIG. 7 is a cross-sectional diagram of an embodiment of a driving mechanism.

FIG. 7 illustrates a driving mechanism disposed within the fluid passageway, adapted to control at least a portion of the valve mechanism. The driving mechanism may be in communication with a generator 700. One such generator which may be used is the Astro 40 form AstroFlight, Inc. The generator may comprise separate magnetic elements 701 disposed along the outside of a rotor 702 which magnetically interact with a coil 703 as it rotates, producing a current in the electrically conductive coil 703. The magnetic elements 701 are preferably made of samarium cobalt due to its high Curie temperature and high resistance to demagnetization.

The generator 700 may be hydraulically driven by a turbine. The coil 703 may be in communication with a load. When the load is applied, power may be drawn from the generator, causing the generator and thereby the turbine to slow its rotation, which thereby slows the discs of a rotary valve with respect to one another and thereby reduces the frequency of the expanding and contracting of the fluid passageway. The load may comprise a resistor, nichrome wires, coiled wires, electronics, or combinations thereof. The load may be applied and disconnected at a rate at least as fast as the rotational speed of the driving mechanism. There may be any number of generators used in combination. In embodiments where the driving mechanism is a valve or hydraulic motor, a valve may control the amount of fluid that reaches the driving mechanism, which may also control the speed at which the discs rotate relative to each other.

The generator may be in communication with the load through electrical circuitry 704. The electrical circuitry 704 may be disposed within the wall 601 of the fluid passageway 206 of the bit 104. The generator may be connected to the electrical circuitry 704 through a coaxial cable 705. The circuitry may be part of a closed-loop system. The electrical circuitry 704 may also comprise sensors for monitoring various aspects of the drilling, such as the rotational speed or orientation of the generator with respect to the bit 104. The data collected form these sensors may be used to adjust the rotational speed of the turbine in order to control the vibrations of the drill bit.

Figure 8:
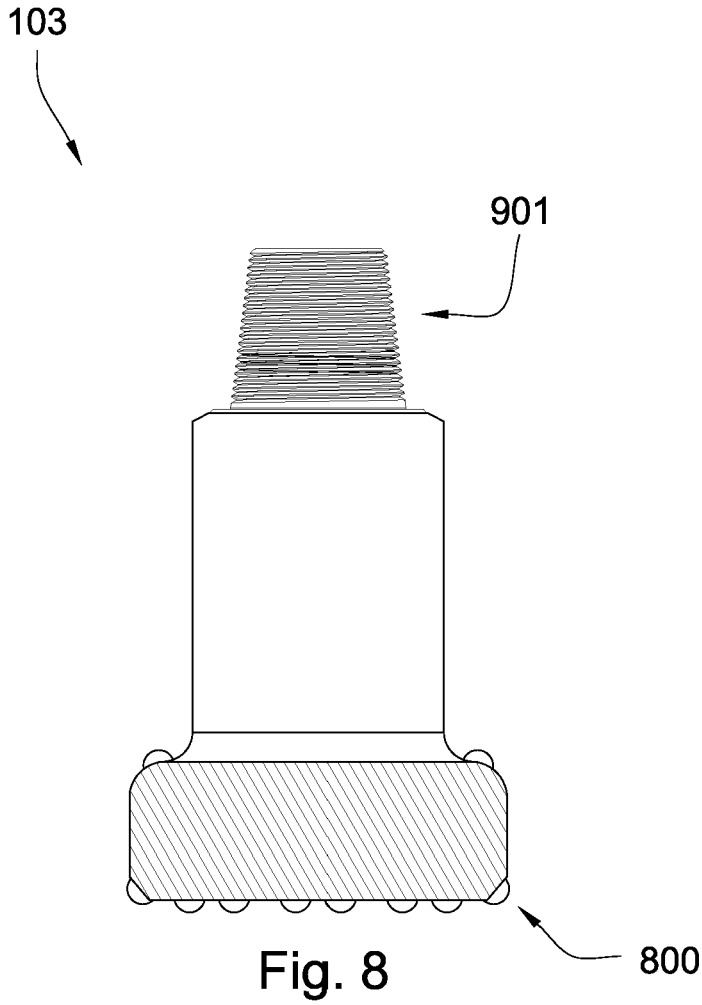
FIG. 8 is a perspective cross-sectional diagram of another embodiment of a bottom hole assembly.

FIG. 8 illustrates a bottom-hole assembly 103 having a percussive drill bit 800. The percussive 800 bit may be threaded into a string of downhole tools at a threaded end or may be welded to the string of downhole tools.

Figure 9:
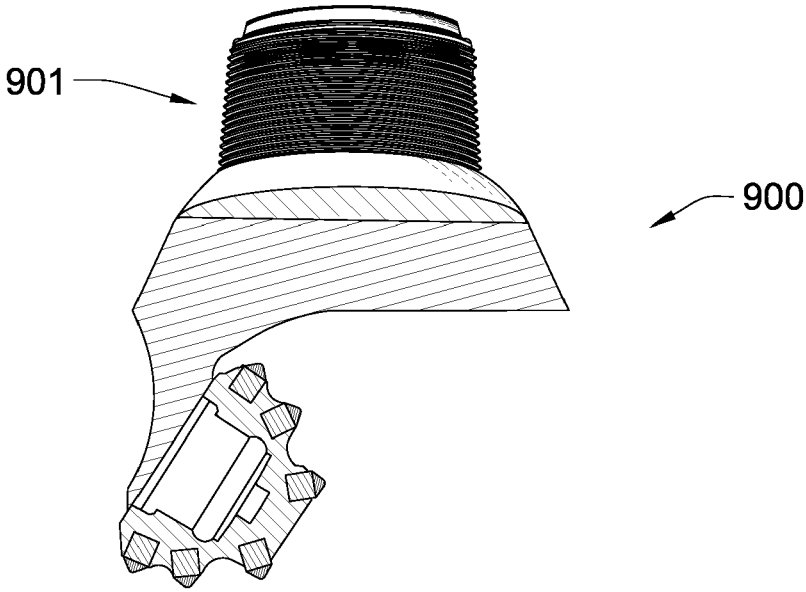
FIG. 9 is a cross-sectional diagram of an embodiment of a rollercone bit.

FIG. 9 illustrates a cross-sectional diagram of an embodiment of a rollercone bit 900 that may be incorporated into the present invention. The rollercone bit may comprise a threaded end 901; the threaded end being adapted to provide connection between the bit 900 and a string of downhole tools.

Figure 10:
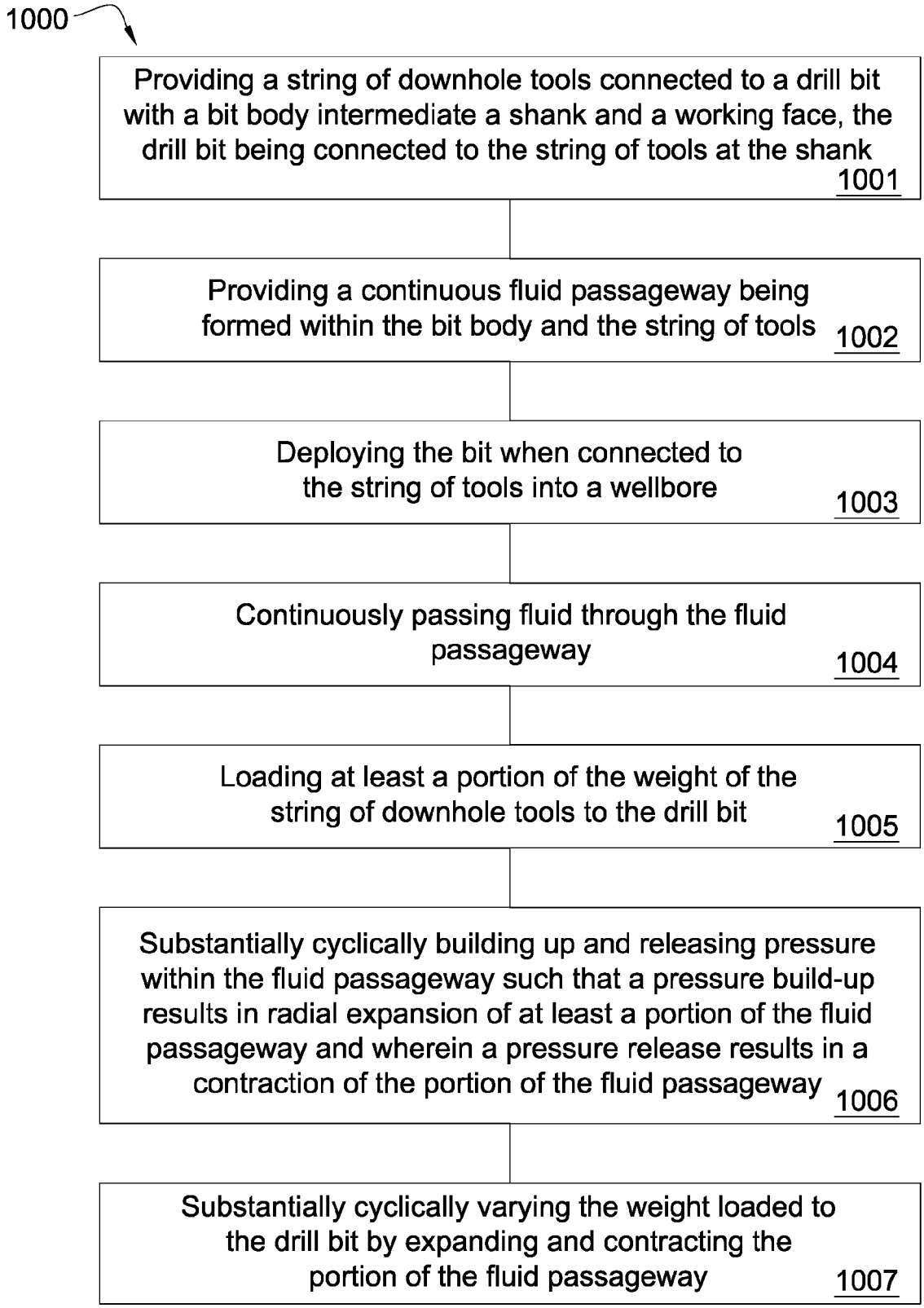
FIG. 10 is a diagram of an embodiment of a method for forming a wellbore.

FIG. 10 is a diagram of an embodiment of a method 1000 for forming a wellbore. The method 1000 includes providing 1001 a string of downhole tools connected to a drill bit within a bit body intermediate a shank and a working face, the drill bit being connected to the string of tools at the shank. The method 1000 also includes providing 1002 a continuous fluid passageway being formed within the bit body and the string of tools. Further, the method 1000 includes deploying 1003 the bit when connected to the string of tools into a wellbore. The method 1000 includes continuously passing 1004 fluid through the fluid passage way and loading 1005 at least a portion of the weight of the string of downhole tools to the drill bit. The method 1000 also includes substantially cyclically building up 1006 and releasing pressure within the fluid passageway such that a pressure build-up results in radial expansion of at least a portion of the fluid passageway and wherein a pressure release results in a contraction of the portion of the fluid passageway. The method 1000 further includes substantially cyclically varying 1007 the weight loaded to the drill bit by expanding and contracting the portion of the fluid passageway.

Whereas the present invention has been described in particular relation to the drawings attached hereto, it should be understood that other and further modifications apart from those shown or suggested herein, may be made within the scope and spirit of the present invention.

What is claimed is:

1. A drilling assembly, comprising:

a string of downhole tools connected to a drill bit with a bit body intermediate a shank and a working face;

the drill bit being connected to the string of tools at the shank;

a continuous fluid passageway being formed within the bit body and the string of tools;

a valve mechanism disposed within the fluid passageway adapted to substantially cyclically build-up and release pressure within the fluid passageway such that a pressure build-up results in radial expansion of at least a portion of the fluid passageway and wherein a pressure release results in a contraction of the portion of the fluid passageway;

wherein the expansion and contraction of the portion of the fluid passageway varies a weight loaded to the drill bit.

2. The assembly of claim 1, wherein the valve mechanism comprises a rotary valve or a relief valve.

3. A method for forming a wellbore, comprising the steps of:

providing a string of downhole tools connected to a drill bit with a bit body intermediate a shank and a working face, the drill bit being connected to the string of tools at the shank;

providing a continuous fluid passageway being formed within the bit body and the string of tools;

deploying the bit when connected to the string of tools into a wellbore;

continuously passing fluid through the fluid passageway;

loading at least a portion of the weight of the string of downhole tools to the drill bit;

substantially cyclically building up and releasing pressure within the fluid passageway such that a pressure build-up results in radial expansion of at least a portion of the fluid passageway and wherein a pressure release results in a contraction of the portion of the fluid passageway;

substantially cyclically varying the weight loaded to the drill bit by expanding and contracting the portion of the fluid passageway.

4. The method of claim 3, wherein the step of substantially cyclically varying the weight loaded to the drill bit vibrates the drill bit.

5. The method of claim 4, wherein a magnitude of the vibrations varies according to the physical properties of a formation being drilled.

6. The method of claim 4, wherein the vibrations of the tool string produce acoustic signals; the signals being received by acoustic receivers located at the tool bit, tool string, or earth surface.

7. The method of claim 3, wherein the drill bit is a shear bit or a rollercone bit.

8. The method of claim 3, wherein the drill bit is rigidly connected to the string of tools at the shank.

9. The method of claim 3, wherein the step of expanding and contracting the inner wall of the tool string is continuous.

10. The method of claim 3, wherein the step of building up and releasing pressure within the fluid passageway is controlled by a valve mechanism disposed within the fluid passageway.

11. The method of claim 10, wherein the valve mechanism comprises a rotary valve or a relief valve.

12. The method of claim 10, wherein the valve mechanism is adapted to restrict all fluid flow within the fluid passageway.

13. The method of claim 10, wherein the valve mechanism is adapted to restrict a portion of fluid flow within the fluid passageway.

14. The method of claim 10, wherein at least a portion of a jack element being disposed within the body and comprising an end forming at least a portion of the valve mechanism in the fluid passageway and a distal end substantially protruding from the working face.

15. The method of claim 14, wherein the jack element is rotationally isolated from the string of downhole tools.

16. The method of claim 10, wherein a portion of the valve mechanism is adapted for attachment to a driving mechanism.

17. The method of claim 16, wherein the driving mechanism is a motor, turbine, electric generator, or a combination thereof.

18. The method of claim 16, wherein the driving mechanism is controlled by a closed loop system.

19. The method of claim 3, wherein the substantially cyclical building-up and releasing of pressure comprises a rate of 0.1 to 500 cycles per second.

20. The method of claim 3, wherein the step of substantially cyclically varying the weight loaded to the drill bit induces a resonant frequency of the formation being drilled.

* * * * *